United States Patent [19]

Sasage et al.

[11] Patent Number: 4,886,596

[45] Date of Patent: Dec. 12, 1989

[54] ADDRESS READING APPARATUS FOR MAIL ARTICLE

[75] Inventors: Tsutomu Sasage; Masahiko Noguchi, both of Tokyo, Japan

[73] Assignee: NEC Corporation, Japan

[21] Appl. No.: 110,114

[22] Filed: Oct. 19, 1987

[30] Foreign Application Priority Data

Oct. 21, 1986 [JP] Japan ..... 61-251017

[51] Int. Cl.[4] ..... B07C 1/18; B07C 3/14

[52] U.S. Cl. ..... 209/539; 209/584; 209/900; 250/557; 382/1

[58] Field of Search ..... 209/539, 569, 583, 584, 209/900, 939; 235/470, 471, 475, 476, 483–485; 250/271, 491.1, 557; 271/2, 226–228; 356/71; 382/1, 65; 353/101

[56] References Cited

U.S. PATENT DOCUMENTS

| | | | |
|---|---|---|---|
| 2,928,953 | 3/1960 | Bassler | 250/557 |
| 3,517,992 | 6/1970 | Holle | 353/101 |
| 4,117,975 | 10/1978 | Gunn | 209/584 X |
| 4,287,409 | 9/1981 | Auchinleck | 235/475 |
| 4,516,264 | 5/1985 | Corvari et al. | 382/1 X |
| 4,738,368 | 4/1988 | Shaw | 209/900 X |

*Primary Examiner*—Dennis H. Pedder
*Assistant Examiner*—Edward M. Wacyra
*Attorney, Agent, or Firm*—Laff, Whitesel, Conte & Saret

[57] ABSTRACT

The invention maintains the focus of a reader in a postal sorting and transporting system which is equipped to read an image of an address on either side of a mail article. The address reading apparatus uses two address readers disposed on opposite sides of a transfer path over which the mail articles travel. An address-carrying surface detector is disposed along the transfer path and upstream of the two address readers. Two floating roller pairs are provided at the inlet and the outlet of the address readers, to hold the mail article therebetween. A pressure roller driving mechanism responds to an output signal delivered from the address-carrying surface detector for selectively fixing one roller of either roller pair at a predetermined distance from the mail article's address carrying surface so that the distance between the address carrying surface and the appropriate address reader is kept constant. This constant distance fixing compensates for variations in the thickness of the mail article in order to maintain an accurate focus.

8 Claims, 2 Drawing Sheets

ADDRESS READING APPARATUS FOR MAIL ARTICLE

BACKGROUND OF THE INVENTION

This invention relates to a mail processing apparatus, and more particularly to an address reading apparatus for a mail article, the apparatus being adapted to read the address description on either surface of the mail article.

A mail processing apparatus reads an address description on a mail article having various thicknesses. Two reading devices are frequently provided for reading both sides of a transfer path in order that address reading can be done regardless of which surface of the mail article is presented for reading.

A conventional address reading apparatus of this kind including two reading devices on opposite sides of a transfer path has a construction shown in FIG. 1. This apparatus comprises address readers 1 and 2 disposed in opposition to each other on both sides of a transfer path for reading an address description on a mail article. Pinch rollers 3 and 4 are disposed at the inlet and the outlet of the address readers 1 and 2. Pressure rollers 5 and 6 are disposed in contact with the pinch rollers 3 and 4. Guide plates 7 and transfer belts 8 and 9 form the transfer path. Address description detectors 10 and 11 are disposed on both sides the transfer path and upstream of the address readers 1 and 2.

The address description detectors 10, 11 detect the surface of the mail article on which the address description is written. To this end, the detectors 10 and 11 sense, for example, a postage stamp and a particular mark indicating the surface carrying the address description of the mail article. Therefore, before the mail article reaches the address readers 1 and 2, the system has detected which surface is carrying the address that is present on either the upward or the downward surface. When the mail article is transferred to a location between the address readers 1 and 2, it is held by a pair comprising the pinch roller 3 and the pressure roller 5 and by a pair comprising the pinch roller 4 and the pressure roller 6. The address description is read out by one of the address readers 1 and 2.

In FIG. 1, the pinch rollers 3 and 4 are rotated at fixed positions. The pressure rollers 5 and 6 are movably pressed against the rollers 3 and 4 by means of levers and suitable springs 12 and 13. Accordingly, when the mail article is held between the pinch rollers 3 (4) and the pressure rollers 5 (6), the pressure rollers 5 and 6 are moved in accordance with a thickness of the mail article.

In the above-described conventional address reading apparatus, the distance between the address reader 1 on the side of the pinch rollers 3 and 4 and a surface of a mail article is kept constant. However, the distance between the address reader 2 on the side of the pressure rollers 5 and 6 and the surface of the mail article varies by at least the thickness of the mail article since the pressure rollers 5 and 6 are moved away from their normal position in accordance with the thickness of the mail article. Therefore, the address reader 2 does not have a fixed distance focus upon the image of the address description formed on a scanning device via a lens. Accordingly, the address description cannot always be read accurately. Such a drawback is affected to a great amount, especially, when a mail article of 5 to 6 mm in thickness is processed.

It is possible to use an optical system having a deep focused range and having a mechanism for focusing a lens in accordance with the distance to the surface of a mail article to be read in order to overcome the drawback. However, such an optical system becomes complicated and expensive, and is not practical.

SUMMARY OF THE INVENTION

It is, therefore, an object of the present invention to provide an address reading apparatus for a mail article, which is capable of eliminating the drawback encountered in the above-described conventional address reading apparatus, while using a simple optical system.

According to the present invention, an address reading apparatus for a mail article provides an image of an address description on either surface of a mail article which is accurately focused by a scanning device in the address readers of both sides of the path, irrespective of the thickness of the mail article.

The address reading apparatus of the present invention comprises two address readers disposed on opposite sides of a transfer path, in opposition to each other for reading an address description on a surface of a mail article. An address-carrying surface detector is disposed upstream of the two address readers and is disposed along the transfer path for detecting an address description-carrying surface of the article. Two roller pair mechanisms are provided at the inlet and the outlet of the address readers. Two pressure rollers in each roller pair mechanism are disposed on opposite sides of the transfer path and engage each other to hold with mail article therebetween. The pressure roller driving means is responsive to an output signal delivered from the address-carrying surface detector for fixing either pressure roller at a predetermined position, whereby the distance is constant between the address description-carrying surface and the address reader facing the address surface.

DESCRIPTION OF THE PREFERRED EMBODIMENT

Figure 1:
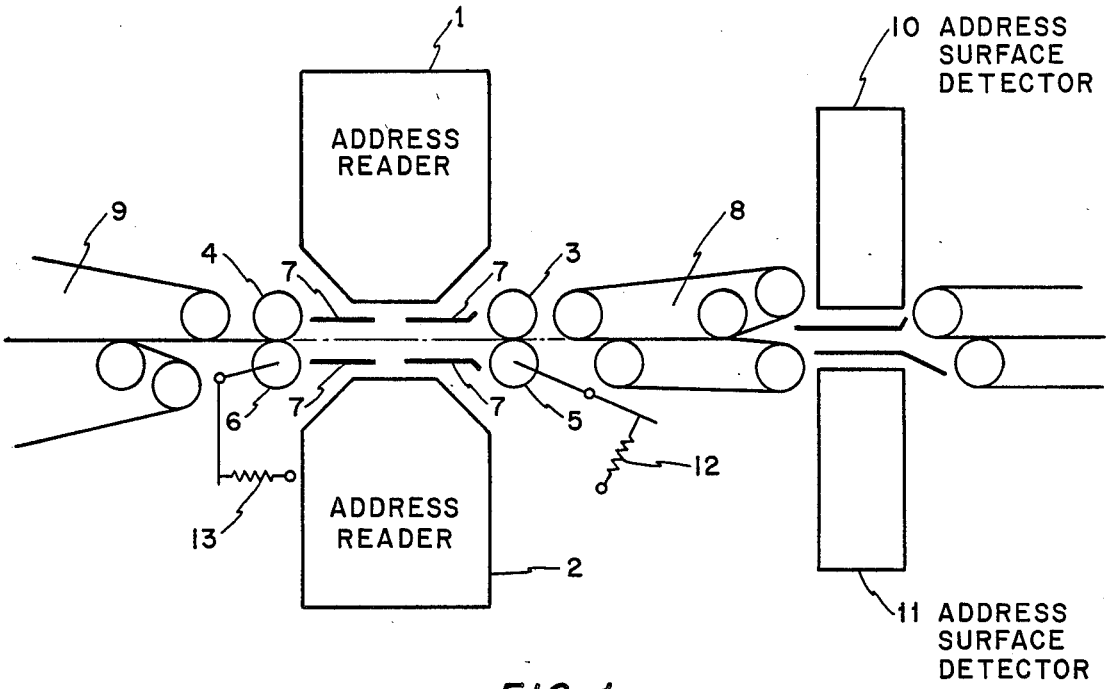
FIG. 1 PRIOR ART
FIG. 1 shows the constructive diagram of a conventional address reading apparatus for a mail article.
Figure 2:
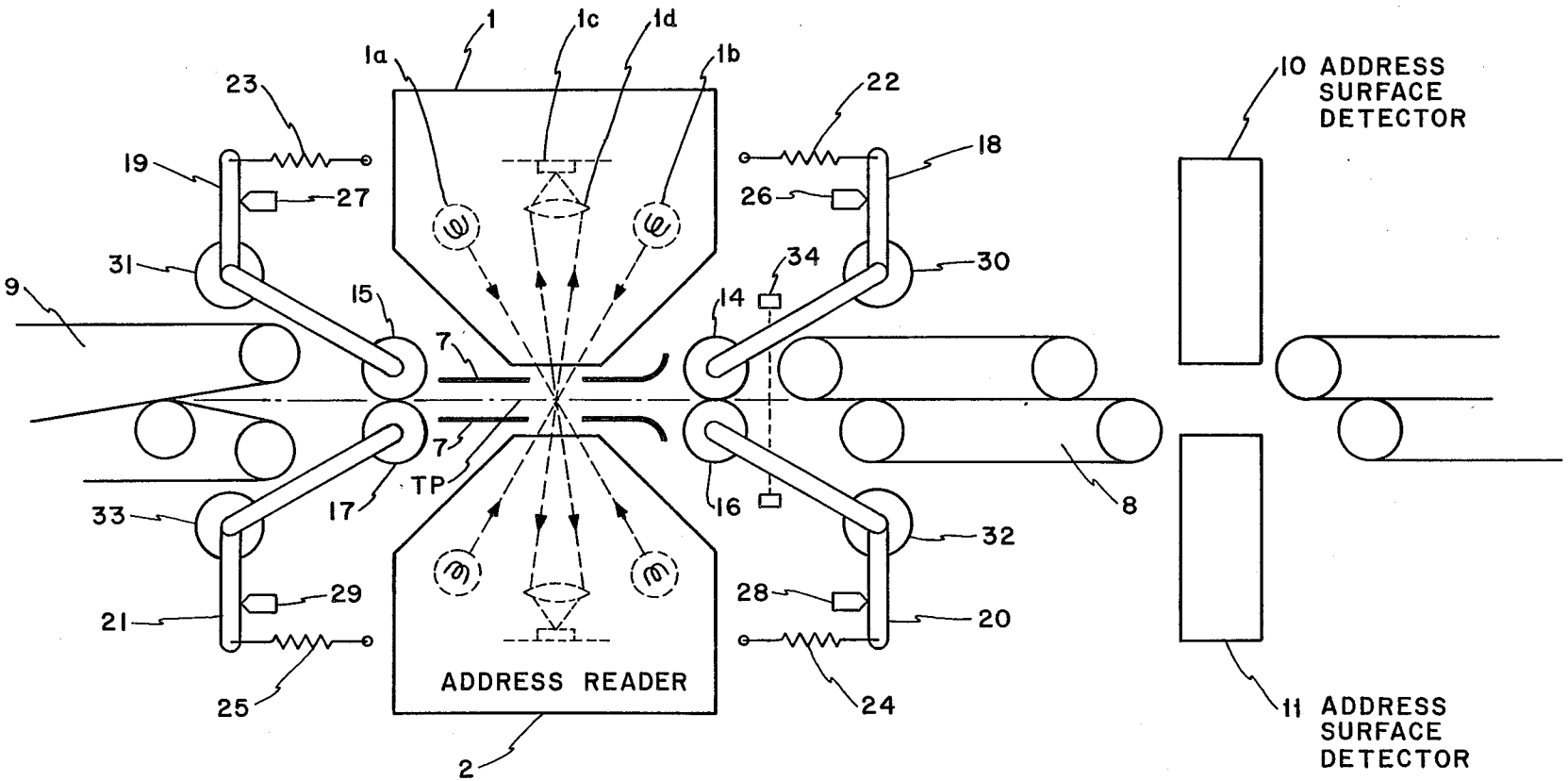
FIG. 2 shows a constructive diagram of an embodiment according to the present invention.

An embodiment of the present invention will now be described with reference to the drawings. In FIG. 2, showing an embodiment of the present invention, two address readers 1 and 2 are provided for reading an address description on either surface of a mail article. The guide plates 7, transfer belts 8 and 9 and detectors 10 and 11 are identical with the corresponding parts shown in FIG. 1.

In greater detail, each of the address readers 1 and 2 includes light sources 1*a* and 1*b*, a scanning device 1*c*, and a lens 1*d* for focusing an image of the address description onto the scanning device 1*c*. The guide plates 7 are provided in front of the address readers 1 and 2. In this embodiment, the focus of lens 1*d* in the scanning device 1*c* in the address readers 1 and 2 is fixed on an ideal transport path position TP. Therefore, a very simple and inexpensive optical system can be employed in the present invention.

In a feature of the present invention, pressure rollers 14, 15, 16 and 17 are provided in addition to the parts arranged as mentioned above. These pressure rollers are disposed at the inlet and the outlet of the address readers 1 and 2, along the transfer path. The pressure rollers 14 and 16 (15 and 17) are provided on both sides of the transfer path and are engaged with each other at the ideal transfer path position TP. A suitable force level is maintained by means of arms 18 and 20 (19 and 21) and by springs 22 and 24 (23 and 25). In this case, the pressure rollers 14 to 17 are rotated at the same speed as the transfer speed.

Stoppers 26 to 29 are provided with respect to the arms 18 to 21 so that the pressure rollers 14 to 17 do not press against the opposed pressure rollers across the ideal transfer path position TP. On their rotary centers, the arms 18 to 21 are provided with solenoids 30 to 33. When a driving current is applied to these solenoids, the arms are pressed against the stoppers 26–29, so that the pressure rollers can not move away from the ideal transport path position TP. In addition, a mail article detector 34 (FIG. 3) is provided upstream of the address readers 1 and 2, so as to produce a solenoid-driving timing.

Figure 3:
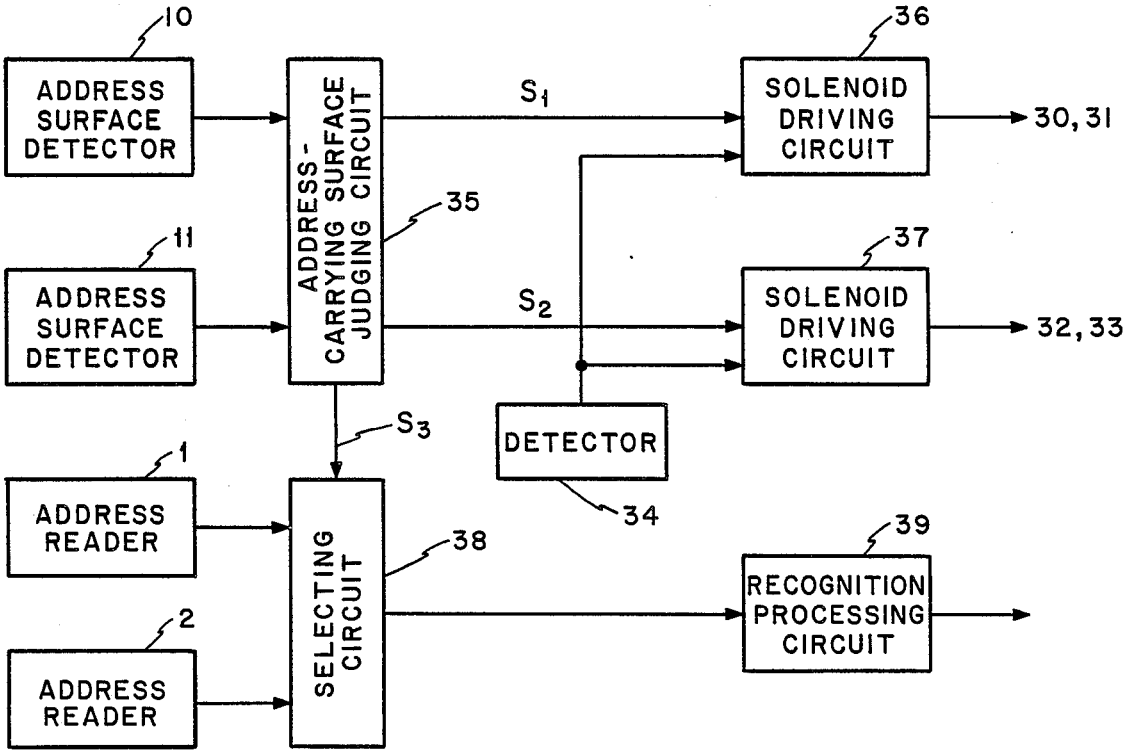
FIG. 3 is a block diagram of a control circuit for the embodiment of FIG. 2.

The operation of the embodiment of the present invention will now be described with reference to FIG. 2 and FIG. 3 showing the block diagram of a control circuit. As previously mentioned, the address description-carrying surface has indicating information such as a predetermined mark or a postage stamp. This information is detected by the detectors 10 and 11 (FIG. 2) which are provided on opposite sides of the transfer path. The outputs from the detectors 10 and 11 are sent to an address-carrying surface judging circuit 35 (FIG. 3). An output signal $S_1$ or $S_2$, representative of the address-carrying surface, is delivered from the circuit 35.

When the address-carrying surface faces the address reader 1, for example, the output signal $S_1$ is supplied from the circuit 35 to a rotary solenoid driving circuit 36. Consequently, the rotary solenoids 30 and 31 (FIG. 2) associated with the driving circuit 36 are actuated to press the arms 18 and 19 against the stoppers 26 and 27. As a result, the rims of the pressure rollers 14 and 15 are in fixed positions at the ideal transfer path position TP. The surface of the mail article which is to be scanned by the address reader 1 is thereby fixed at a position where lens 14 is in focus. During this time, the other pressure rollers 16 and 17 contacting these pressure rollers 14 and 15 are moved away (moved down in FIG. 1) from the ideal transfer path position TP in accordance with the thickness of the mail article, since the solenoids 32 and 33 are not activated.

Conversely, when the judgement circuit 35 judges that the address-carrying surface faces the address reader 2, the output signal $S_2$ is supplied from the circuit 35 to a rotary solenoid driving circuit 37 to actuate the rotary solenoids 32 and 33. As a result, the rims of the pressure rollers 16 and 17 are in fixed positions at the ideal transfer path TP position. In this embodiment, the mail article detector 34 is adapted to supply a reference signal for driving timing to the rotary solenoid driving circuits 36 and 37. In FIG. 3, read-out signals delivered from the address readers 1 and 2 are supplied to a selecting circuit 38. One of the two read-out signals is selected in accordance with a selecting signal $S_3$ delivered from the address-carrying surface judging circuit 35. The selected read-out signal is sent to a recognition processing circuit 39.

According to the present invention as described above, in the case of providing two address readers on opposite sides of the transfer path, the distance between the scanning device in the address reader and the address-carrying surface of the mail article can be fixed and constant with respect to both the address readers, irrespective of the thickness of the mail article even when the address description is present on either surface of the mail article. This prevents a de-focus and, therefore, the address description on the mail article can be read-out accurately.

What is claimed is:

1. An apparatus for reading information on a flat article, the apparatus comprising:

a transfer path for transferring a flat article having upward and downward surfaces;

an information surface detecting means disposed along said transfer path for detecting which one of said upward and downward surfaces of said flat article has information to be read;

two reading means disposed on opposites sides of said transfer path in opposition to each other and disposed downstream of said information surface detecting means, said reading means being positioned for reading said information on said flat article;

two pairs of two rollers, each pair of said rollers being respectively disposed at an inlet and an outlet of said reading means along said transfer path for holding said flat article to be read, said two rollers nipping said flat article at said inlet and said outlet to hold said flat article; and roller control means responsive to an output of said information surface detecting means for fixing the position of either roller in said pair of two rollers such that a distance between said surface of said flat article having said information thereon is kept constant with respect to the reading means confronting the surface of said flat article having said information thereon.

2. An apparatus for reading the address on a mail article, said apparatus comprising:

a transfer path for transferring a mail article;

address-carrying surface detecting means disposed along said transfer path for detecting an address-carrying surface of said mail article, said address-carrying surface having an address description thereon;

two address reading means disposed on opposite sides of said transfer path in opposition to each other and disposed downstream of said address-carrying surface detecting means for alternatively reading the address description on said flat article;

roller pair means associated with said address reading means and disposed along said transfer path, said roller pair means including two rollers such that said two rollers engage each other to hold said mail article therebetween, at least one roller in each pair being movable in a direction perpendicular to a transfer direction in accordance with thickness of said mail article; and roller position control means coupled to said roller pair means for fixing a position of either roller in two engaging rollers contained in said roller pair means in response to a detection signal delivered from said address-carrying surface detecting means, whereby a constant distance is held between said address-carrying surface and one of said two address reading means.

3. An address reading apparatus as claimed in claim 2, wherein said roller pair means are disposed at an inlet and an outlet of said address reading means.

4. An address reading apparatus as claimed in claim 2, wherein said roller pair means includes:

movable arm means attached to a movable one of said rollers contained in said roller pair means, spring means coupled to said arm means for enabling said roller to floatingly move in accordance with the thickness of said mail article, stopper means associated with said arm means for limiting a movable range of said roller to a position corresponding to said transfer path, and arm fixing means responsive to said detection signal delivered from said address-carrying surface detecting means for limiting the movement of said arm to said stopper means.

5. An apparatus for reading information on a sheet, said apparatus comprising two information readers disposed in opposition to each other on opposite sides of a sheet transfer passage for reading information written on one surface of a sheet, information-carrying surface detecting means disposed along said transfer passage and disposed upstream of said information readers for detecting which surface of said sheet is carrying information, two pairs of pressure rollers disposed at an inlet and an outlet of said information readers, rollers in each of said pairs of rollers engaging each other and being disposed on opposite sides of said transfer passage, pressure roller driving means responsive to an output signal delivered from said information-carrying surface detecting means for driving said pressure rollers in a direction which is perpendicular to a transfer direction, and stopper means associated with said pressure rollers for restricting the movement of said pressure rollers for restricting the movement of said pressure rollers so that a distance between said surface having said information thereon and one information reader facing said surface is a fixed distance.

6. A machine for reading information appearing on the surface of an article which may have any of many different thicknesses, said machine comprising a pair of opposed reader means confronting opposite surfaces of said article whereby one of said reader means is able to read said information regardless of which of said opposite surfaces has said information appearing thereon, means for detecting which of said opposite surfaces has said information thereon, means responsive to said detecting means for holding the surface having said information thereon a fixed distance from the one of said reader means which confronts the surface having said information thereon, means for transporting at said fixed distance said article past said reader means confronting the surface having said information thereon, said transporting means comprising at least one pair of nip rollers through which said article passes, means for floatingly mounting each of said nip rollers to move between a surface of said article and a fixed stop, and wherein said means for holding comprise means for pressing said rollers so that they move to a stop adjacent said reader means confronting said surface with said information thereon.

7. A machine for reading information appearing on the surface of an article which may have any of many different thicknesses, said machine comprising a pair of opposed reader means confronting opposite surfaces of said article whereby one of said reader means is able to read said information regardless of which of said opposite surfaces has said information appearing thereon, means for detecting which of said opposite surfaces has said information appearing thereon, means responsive to said detecting means for holding the surface having said information thereon a fixed distance from the one of said reader means which confronts the surface having said information thereon, means for transporting at said fixed distance said article past said reader means confronting the surface having said information thereon, said transporting means comprising two pair of nip rollers through which said article passes, means for floatingly mounting each of said nip rollers to move between a surface of said article and a fixed stop, means for pressing said rollers so that they move to a stop adjacent said reader means confronting said surface with said information thereon, one of said pairs of rollers engaging said article as it approaches said reader means and the other of said pairs of rollers engaging said article as it leaves said reader means, each of said rollers being floating mounted to move between said surfaces and said stops, and means responsive to said detecting means for pressing all of said rollers against said stop adjacent said reader means confronting said surface with said information thereon.

8. The machine of claim 7 and a spring biased lever means individually associated with each of said rollers for providing said floating mount for said individually associated roller and electromechanical means for selectively moving the levers against the stop adjacent the reader means confronting the surface having said information thereon.

* * * * *